US006042489A

United States Patent [19]

Renard et al.

[11] Patent Number: 6,042,489

[45] Date of Patent: Mar. 28, 2000

[54] SOLID GOLF BALL WITH PRESTRETCHED INTERMEDIATE LAYER

[75] Inventors: Philippe Renard, La Balme De Sillingy, France; Hyun Kim, Vista, Calif.; Dean Snell, Oceanside, Calif.; Benoit Vincent, Leucadia, Calif.

[73] Assignee: Taylor Made Golf Company, Inc., Carlsbad, Calif.

[21] Appl. No.: 08/953,892

[22] Filed: Oct. 20, 1997

[51] Int. Cl.[7] ..... A63B 37/06

[52] U.S. Cl. ..... 473/374; 473/366; 473/376

[58] Field of Search ..... 473/366, 373, 473/374, 375, 376, 361–365, 357–359, 351, 354

[56] References Cited

U.S. PATENT DOCUMENTS

| | | | |
|---|---|---|---|
| 696,887 | 4/1902 | Kempshall | 473/376 X |
| 697,921 | 4/1902 | Kempshall | 473/376 X |
| 698,402 | 4/1902 | Kempshall | 473/366 X |
| 704,881 | 7/1902 | Kempshall | 473/365 X |
| 726,502 | 4/1903 | Browning et al. | 473/363 |
| 730,303 | 6/1903 | Seaman | 473/366 |
| 736,231 | 8/1903 | Davis | 473/358 |
| 786,524 | 4/1905 | Sieberling | 473/366 X |
| 4,337,946 | 7/1982 | Saito et al. . | |
| 4,919,434 | 4/1990 | Saito et al. . | |
| 5,184,828 | 2/1993 | Kim et al. . | |
| 5,253,871 | 10/1993 | Viollaz . | |
| 5,314,187 | 5/1994 | Proudfit . | |
| 5,439,227 | 8/1995 | Egashira et al. . | |
| 5,688,595 | 11/1997 | Yamagishi et al. . | |
| 5,725,442 | 3/1998 | Higuchi et al. . | |
| 5,730,665 | 3/1998 | Shimosaka . | |
| 5,743,816 | 4/1998 | Ohsumi et al. . | |
| 5,752,888 | 5/1998 | Maruko et al. . | |
| 5,762,568 | 6/1998 | Kato . | |
| 5,772,531 | 6/1998 | Ohsumo et al. . | |
| 5,816,937 | 10/1998 | Shimosaka et al. . | |

FOREIGN PATENT DOCUMENTS

| | | |
|---|---|---|
| 2278609 | 7/1994 | United Kingdom . |

*Primary Examiner*—George J. Marlo
*Attorney, Agent, or Firm*—Knobbe, Martens, Olson & Bear, LLP.

[57] ABSTRACT

A solid golf ball having a core, a cover, an intermediate skin between the core and the cover defining a generally continuous inner annular surface, wherein the inner annular surface of the skin is stretched over the core. Desirably, to prevent breakage, the annular surface is at least ¼ inch wide. Preferably, the skin has a substantially uniform thickness and covers substantially the entire outer surface of the core so that the golf ball will react in a uniform manner regardless of where on the cover the ball is struck. The skin preferably comprises a polymeric material which is stretched so as to have a predetermined amount of initial strain so as to reach a certain level of crystallization of material. This predetermined amount of initial strain is desirably 150%, preferably 200% and, most preferably 400%. A method of manufacturing a golf ball having a stretched intermediate skin is also disclosed.

31 Claims, 7 Drawing Sheets

SOLID GOLF BALL WITH PRESTRETCHED INTERMEDIATE LAYER

FIELD OF THE INVENTION

The invention is directed to a solid golf ball having properties similar to a thread-wound golf ball and, in particular, to a solid golf ball capable of being easily controlled and having "good feel." The invention also relates to the method of manufacturing the same.

BACKGROUND AND SUMMARY OF THE INVENTION

There are two common types of golf balls: thread-wound golf balls and solid golf balls, such as two-piece golf balls. Two-piece golf balls have the advantageous characteristics of having excellent durability and flying distance. On the other hand, a two-piece golf ball is generally harder than that of a thread-wound golf ball, resulting in a loss of feel and control. Feel is the result of many parameters, including hardness, and is difficult to characterize. Improved control, on the other hand, typically arises from a higher spin rate. Because feel and control are highly valued by skilled players, skilled players typically utilize a thread-wound golf ball.

Unfortunately, thread-wound golf balls are relatively difficult to manufacture. Specifically, thread-wound golf balls are manufactured by winding a natural or synthetic rubber thread around a center until the desired diameter is reached. The characteristics of the resulting golf ball are achieved by controlling center size and type, winding tension, thread size, "wound" thickness, cover thickness and cover design. Unfortunately, controlling these characteristics requires relatively sophisticated and expensive winding and tensioning apparatus.

Further, because the elastic thread of wound balls is wound under high tension, there is a risk of the thread snapping during winding, as well as in later manufacturing steps. For example, injection molding generally causes the thread to snap during injection of the molten plastic around it. Thus, the use of thread limits the choice of possible techniques employed to apply the cover around the wound center and the cover is generally compression-molded around the wound.

The concentricity of the wound subassembly is also difficult to control precisely during the manufacturing process. Proper concentricity requires precise adjustment of many parameters, including thread tension, winding speed, and the rotational position of the center. As a result, the manufacture of thread-wound golf balls tends to be relatively delicate and expensive.

Yet another drawback of thread-wound golf balls is the risk of thread snap after manufacture. This risk is exacerbated when the ball utilizes a softer cover, such as balata, which is less resistant to cutting.

Therefore, there is needed a golf ball which has properties of control and feel very similar to a thread-wound golf ball, but which avoids the drawbacks of this construction outlined above.

The invention is an improved solid golf ball, which provides a high spin rate for excellent control and "feel" very similar to a thread-wound ball. Advantageously, the golf ball is particularly adapted to be manufactured in a relatively simple and inexpensive manner. The golf ball also lends itself to multiple methods of producing the cover around the core so that there is greater flexibility in ball construction and manufacture.

One aspect of the invention is a solid golf ball having a core, a cover, an intermediate skin between the core and the cover defining a generally continuous inner annular surface, wherein the inner annular surface of the skin is stretched over the core. Desirably, to prevent breakage, the annular surface is at least ¼ inch wide. Preferably, the skin has a substantially uniform thickness and covers substantially the entire outer surface of the core so that the golf ball will react in a uniform manner regardless of where on the cover the ball is struck.

The skin may advantageously comprise a single piece, so that the skin may be applied in a single process. Desirably, the inner surface of the skin has a constant diameter so that the skin is stretched an equal amount over the surface of the core. The skin preferably comprises a polymeric material which is stretched so as to have a predetermined amount of initial strain so as to reach a certain level of crystallization of material. This predetermined amount of initial strain is desirably at least 150%, preferably at least 200% and, most preferably at least 400%.

The prestretching of the polymeric material of the skin causes the material to crystallize. This microstructural crystallization abruptly changes its properties of resilience, elastic modulus and viscoelasticity. Specifically, the crystallization tends to increase the elastic properties and cause the material to become stiffer, as opposed to springy. Conversely, the viscoelasticity, which is the capability to absorb energy from shock, decreases so that less absorbed energy is lost and more energy is available to increase the flying distance and spin rate of the ball. That is, more of the energy is restituted.

Alternatively, to facilitate application of the skin over the core, the skin may be comprised of a number of discrete annular bands. To enable the skin to be applied quickly, however, the skin preferably should comprise no more than 8 annular bands.

Advantageously, the golf ball of the present invention is particularly adapted to be constructed with mechanical properties comparable to that of a thread-wound ball, and to be manufactured in a relatively simple and inexpensive manner.

Yet another aspect of the invention is a method for making a golf ball including providing a core, providing a skin defining a substantially continuous inner annular surface having a maximum initial diameter less than the external diameter of the core, applying the skin over the core and molding an outer cover around the skin. Advantageously, the method may further comprise forming the skin by dipping a template in a bath comprising a dispersion of polymeric material.

These and other aspects of the invention will now be described in connection with a preferred embodiment, which is intended to illustrate, rather than limit the invention.

DETAILED DESCRIPTION OF THE PREFERRED EMBODIMENT

Figure 1:
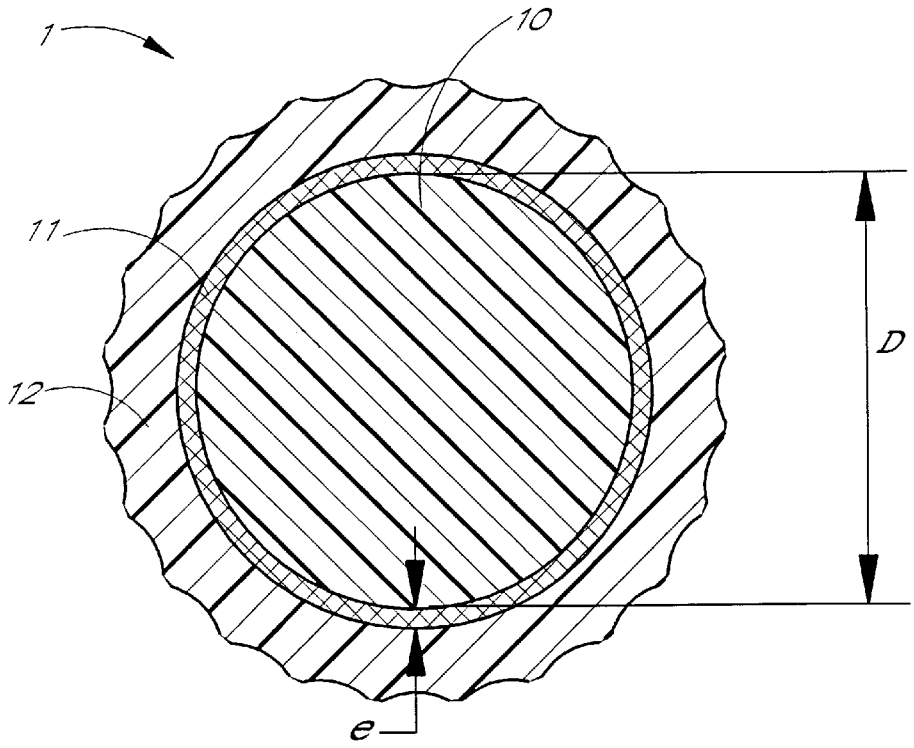
FIG. 1 is a cross-sectional view of a preferred solid golf ball of the present invention.

FIG. 1 shows a preferred embodiment of a golf ball 1 comprising a solid center or core 10, a thin skin 11 of soft polymeric material surrounding the core and a cover 12 of thermoplastic material positioned around the skin.

The core 10 is preferably formed of the solid polymeric material. Suitable polymeric material may comprise either a rubber or a plastic. In a preferred example, the core contains 1,4-polybutadiene having more than 40 wt percent of the cis structure. Desirably, the cis structure is at least 90% by weight of the polybutadiene. Other rubbers, including natural and synthetic rubbers can be utilized in connection with the 1,4- polybutadiene. The material desirably also contains a cross-linking agent, such as a metal salt of an unsaturated fatty acid. Such a salt could be a zinc salt, or magnesium salt of an unsaturated acid such as methacrylic acid or acrylic acid, or an ester. The core may also include a filler, preferably comprising a metal oxide or salt such as zinc oxide, barium sulfate, calcium carbonate, silica, or calcium oxide. Further, a polymerization initiator may be included, preferably an organic peroxide such as dicumyl peroxide.

For a struck golf ball to rebound with the desired characteristics off the face of a club head, the core, which is the engine of the golf ball, must have certain physical properties. These properties are greatly influenced by its size and its PGA compression value. Advantageously, the ball has a compression value between 30 to 100 for a core diameter comprised between 1.35" to 1.60".

The PGA compression value is determined by measurement with a standard ATTI compression gauge known to those in the art.

The core 10 is covered with a thin skin 11 of soft polymeric material which is in a prestretched condition around the core. Importantly, the portion of the skin which contacts the core surface is prestretched sufficiently that a predetermined crystallization level of the polymeric structure occurs to achieve certain physical characteristics. Depending on the nature and hardness of the material, the level of strain to obtain the beneficial characteristics desired may vary significantly.

While the starting point and rate of crystallization will vary based upon various parameters, such as temperature and strain rate, the golf ball is desirably designed to achieve the desired crystallization rate at room temperature. The strain is desirably achieved by surrounding the core having a given external diameter with a bladder defining a cavity having an inner annular and, preferably, spherical surface with an internal diameter smaller than the external diameter of the core. This provides the initial strain which provides the desired crystallization. Advantageously, the skin comprises an elastomeric polymeric material which is easily crystallized under a given level of strain. Applicant has determined that the bladder must be stretched to a level of at least 150% of initial strain to achieve the desired crystallization. Preferably, the material is stretched to at least 200% of the initial strain level and most preferably to at least 400% of initial strain level.

In contrast to a thread-wound structure, the skin 11 advantageously constitutes a continuous layer of substantially uniform thickness around the core. As a result, the skin resists cutting better than a thread-wound structure. That is, a tensioned thread will have a tendency to snap even if a tiny nick is accidentally made in the cover. As discussed above, this risk is exacerbated by the use of soft covers such as balata or polyurethane covers. Further, the uniform thickness of the skin helps ensure that the ball will perform in a consistent manner, regardless which portion of the ball is struck with a golf club.

Advantageously, the skin material is desirably among the members of the following group: natural rubber (NR), synthetic polyisoprene, polybutadiene rubber (BR), silicon rubber and polychloroprene and mixtures thereof. Natural rubber is particularly desirable in that is crystallizes easily when stretched because of its regular structure. Natural rubber is cis 1,4- polyisoprene. It is derived from the species *Hevea Brasiliensis*. Natural rubber is a linear, long chain polymer, with repeating isoprenic units ($C_5H_8$). Natural rubber has a density of approximately 0.93 g/cc at 20° C. and has an average molecular weight of 300,000 to 500,000. Natural rubber is generally less expensive than synthetic rubbers and is available in various soft grades.

In addition to natural rubber, polybutadiene is also a desirable material for use in forming the skin. Polybutadiene has a tendency to crystallize because of the regularity of its structure. On the other hand, the specific characteristics of the polybutadiene depends on the amount of cis, trans and vinyl forms present. For example, high cis polybutadiene crystallizes at about −40° C. and at room temperature when stretched over 200%. On the other hand, a polybutadiene having a high trans content, such as 70–80%, also tends to crystallize when stretched. Synthetic elastomers, such as EPDM, polyether-base elastomer and polyamide-base elastomer may also be used. Certain thermoplastics may also be desirable, such as polyethylene and polyamides.

It has been determined that the skin should have a thickness between 0.05 to 1.3 mm. When the skin is less than 0.05 mm, the skin has insufficient strength and tends to shear during manufacture or after the golf ball is struck relatively few times. Likewise, if the thickness of the skin is too thick, especially if it is greater than 1.3 mm, the skin may tend to absorb energy and act as a cushion which will cause a loss of initial velocity and ball distance. It will also cause the ball to feel too soft and "mushy."

Advantageously, to facilitate the molding of the cover 12 over the core 10, the soft feeling of the golf ball and a satisfactory spin level, the skin 11 must be soft. Specifically, Applicant has determined that the material must have the hardness between 30–90 shore A (corresponding to about 9 to 39 shore D). These ranges are the hardness of the material prior to polymer crystallization (e.g., before the material is stretched).

The cover 12 may comprise any kind of polymeric material satisfactory for use in making covers for golf balls. As discussed above, the present invention is desirable in that it facilitates the use of a wide variety of covers and the application of these covers through a wide variety of means. The cover may comprise one or more layers of thermoplastic material. Advantageously, however, the cover may be an ionomer (such as the variety of ionomers sold by DuPont Chemical Co. under the trademark SURLYN), polyether block amide (such as PEBAX sold by the French company Atochem), polyether block ester (such as PEBE sold by DuPont under the trademark HYTREL), polyurethane, or balata (a naturally occurring substance or its synthetic equivalent commonly sold by Kuraray Isoprene Co., Ltd.). The cover may also be made of various blends of these materials.

Desirably, the cover 12 has an inside diameter of between 1.35" and 1.64" and has a thickness between 0.020" and 0.175".

The method of manufacturing the golf ball of FIG. 1 will now be described in connection with FIGS. 2–12.

The core 10 or center may be formed by any technique known to those of skill in the art. Typically, when a polybutadiene core of the aforementioned characteristics is used, the core 10 will be prepared by means of mixing the components and kneading in a kneader or a mixer. The core is then cured by compression molding in a spherical mold of the desired diameter under heat and high pressure. Alternatively, if the core is made of thermoplastic base material, the core may be molded by injection molding.

Figure 2:
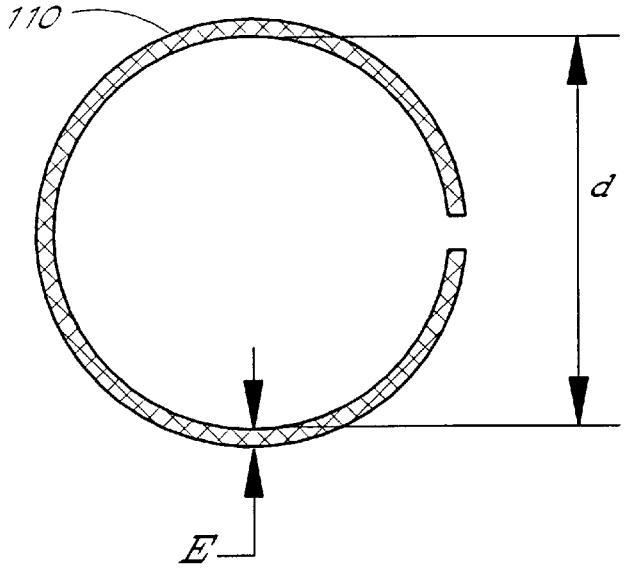
FIG. 2 is a cross-sectional view of a bladder for use in manufacturing the golf ball of FIG. 1, prior to stretching.
Figure 3:
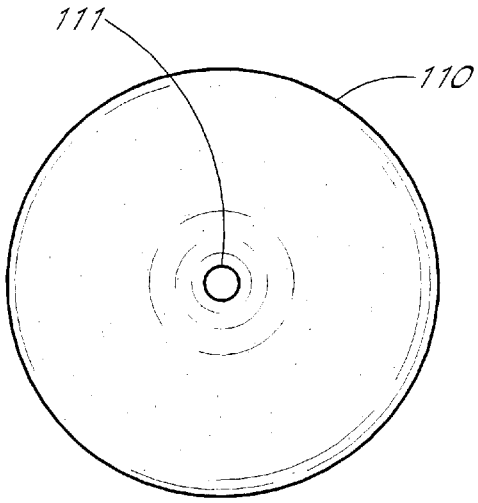
FIG. 3 is an elevational view of the bladder of FIG. 2.

FIG. 2 illustrates a rubber bladder defining an internal cavity having an internal diameter d smaller than the external diameter of the core D (FIG. 1). To provide for a generally uniform thickness and amount of crystallization, the bladder desirably has a substantially hollow spherical shape. Again, the diameter d of the bladder is desirably calculated so that the microstructural configuration of the bladder undergoes a given strain amount when the bladder is positioned around the core having an external diameter D. Desirably, this strain amount is at least 150%, preferably, this strain amount is greater than or equal to 200% and most preferably, the strain amount is greater than or equal to 400%.

The desired internal diameter of the cavity of the bladder can be determined by the following formula:

wherein x (in percentage) represents the amount of strain to be produced.

$$\frac{(D-d)}{d}=\frac{x}{100}$$

For example, if the core diameter is equal to 1.55 inches and the desired strain is 400% to achieve the desired crystallization of the rubber material, then the initial inside diameter of the bladder should be 0.31 inches.

As will be appreciated, the thickness E of the bladder will be greater than the thickness e of the skin, due to the stretching of the bladder about the core to form the skin.

Figure 4:
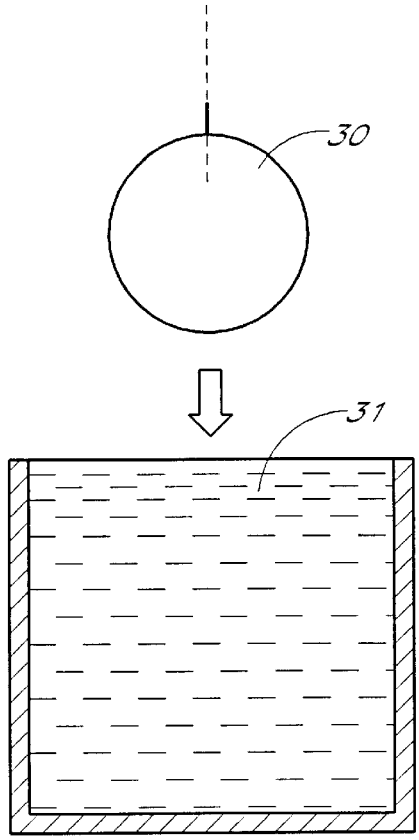
FIG. 4 illustrates the dipping of a template into a solution to form the bladder.
Figure 5:
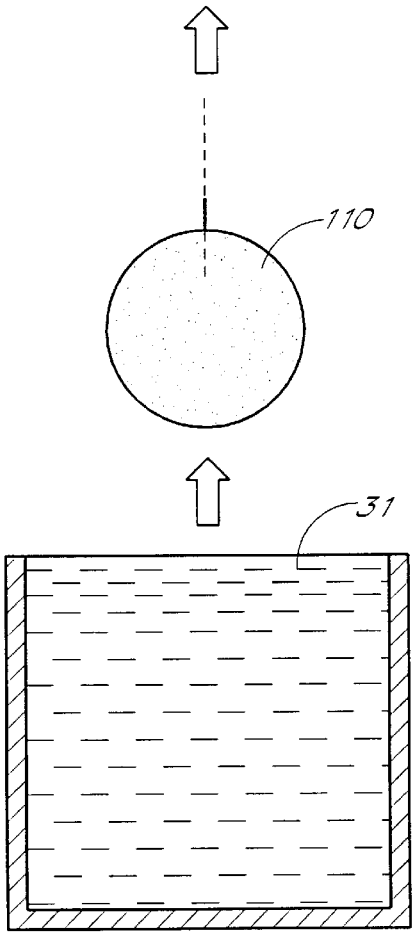
FIG. 5 illustrates the template being removed from the solution.

As discussed above, the bladder preferably comprises a hollow, generally spherical shape. Referring to FIGS. 4 and 5, the bladder is advantageously produced by dipping a template or form 30 into a bath 31 comprising a dispersion of polymeric material. Advantageously, the thickness of the bladder may be increased by successively dipping the bladder in the bath. The thickness of the bladder will also be influenced by the viscosity of the dispersion, the speeds of dissent and assent of the form 30 and the surface roughness of the form. Where it is desired to increase the thickness of the bladder, the template may desirably be first dipped into a coagulating bath, before the form is dipped into the polymeric dispersion. The coagulating bath may include a salt of a bi-valent metallic ion such as calcium nitrate solubilized in alcohol such as methyl alcohol and, optionally, water. Advantageously, the formation of the bladder by dipping preserves the natural chain structure of the elastomer. This is in contrast to the degrading of this structure which occurs in long kneading operations, commonly used in connection with molding and curing techniques. Significantly, the dipping also permits the thickness of the bladder to be controlled precisely and lends itself to the use of light, low cost and low energy consuming machines.

The bladder is desirably formed with a small initial opening 111. While the size of the opening can be any shape, the opening is preferably circular. As shown in FIGS. 6–10, the size of the opening is desirably increased to a diameter greater than the external diameter of the core by mechanical means. For example, a tool, such as a jaw 40, may be inserted into the opening and then the jaw may be opened, stretching the opening to form a larger diameter.

Figure 8:
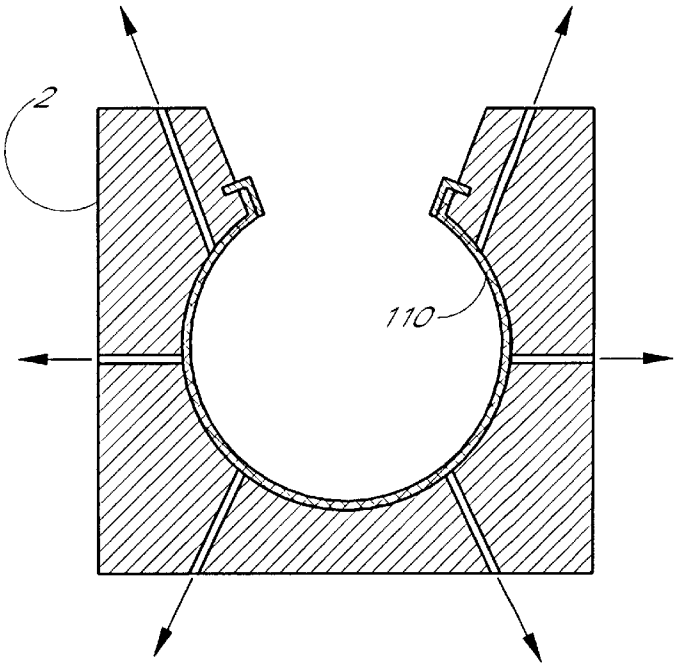
FIGS. 6–12 illustrate additional steps of the method of manufacturing the golf ball of FIG. 1.
Figure 7:
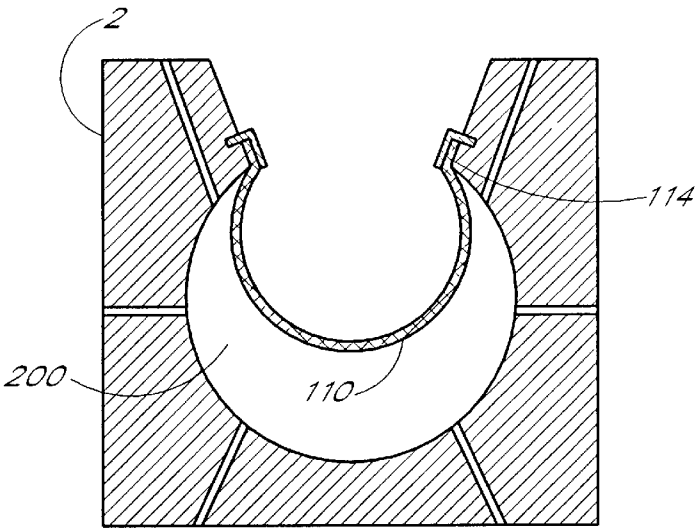
Figure 6:
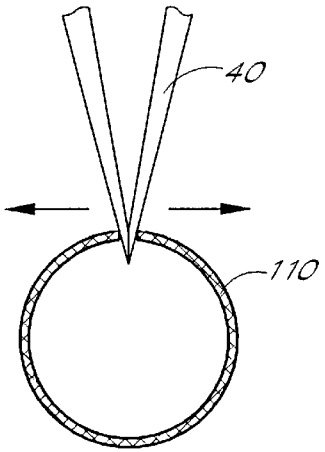
Figure 11:
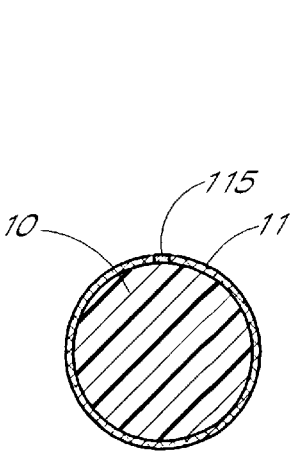
Figure 10:
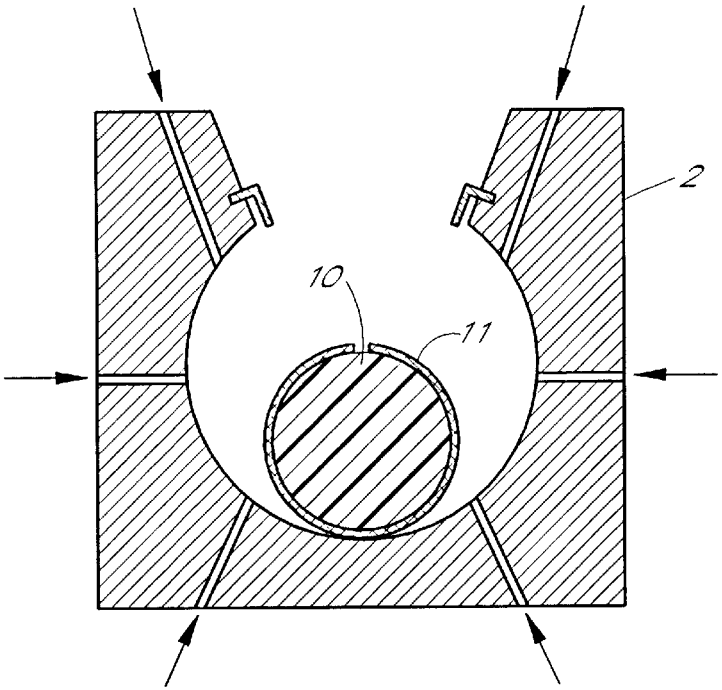
Figure 9:
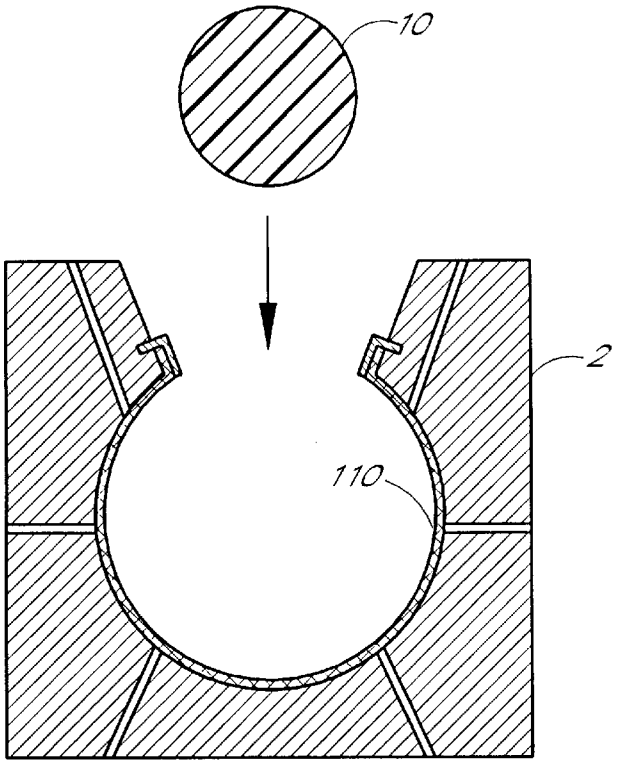
Figure 13:
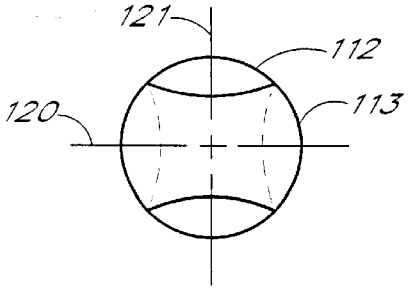
FIG. 13 illustrates a core surrounded by a skin utilized in connection with an alternative embodiment of the golf ball of the present invention.
Figure 14:
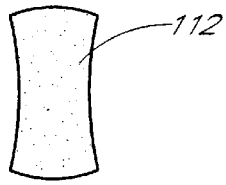
FIGS. 14–19 illustrate the method of forming an alternative embodiment of the golf ball of the present invention.
Figure 15:
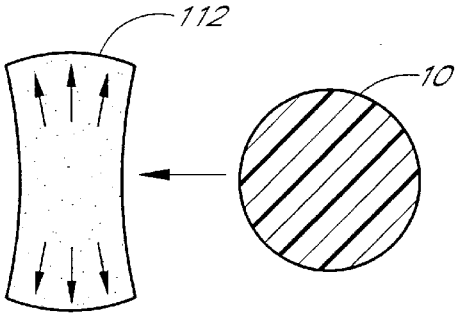

After the initial opening 111 has been stretched sufficiently to accommodate the core 10, the edge 114 of the bladder surrounding the core is clamped to a counterform 2, which defines a substantially circular cavity having a diameter larger than the external diameter of the core. As illustrated by the arrows of FIG. 8, a vacuum is then applied to the cavity 200 to draw the bladder outward into an expanded state adjacent the walls of the cavity defined by the counterform 2. The core is then introduced into the bladder through the enlarged opening 111. As shown in FIG. 10, the vacuum may then be released so that the bladder contracts around the core as shown by the reversed arrows. The opening may then be sealed by any suitable means, such as an adhesive containing rubber agents 115, as illustrated in FIG. 11. In the alternative, the same operation may also be duplicated with a second bladder which covers the opening of the first bladder.

It will be appreciated that the bladder could also be expanded by applying internal pressure to the bladder such as by means of forcing gas into the bladder at a certain pressure $P_0$ which presses the bladder outward until it is forced against the inner walls of the counterform 2. The application of internal pressure can be an alternative to vacuum of an additional means to force the bladder against the counterform.

Yet another alternative would be to enlarge the opening sufficiently to permit the core to be inserted therethrough and to use mechanical force to press the core through the opening. In this regard, it is possible to dress the core with the bladder by hand.

Figure 12:
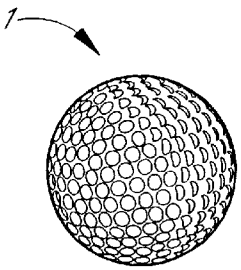

Referring to FIG. 12, once the subassembly comprising the core and its skin is formed, a cover may be molded about it. The cover 12 comprises a layer preferably formed by injection or compression molding processes, well known to those of skill in the art.

FIGS. 13–19 show an alternative embodiment of the invention. In this embodiment, the skin comprises two relatively wide annular bands 112, 113. Each band forms a substantial portion of a sphere. The bands are applied to the core so as to partly overlap. Advantageously, each band extends along a unique equatorial plane referenced respectively 120, 121. Preferably, where two bands are used, the planes are orthogonal to each other. Alternatively, it will be appreciated, the position, number, and width of the bands of the bladder could be varied. Desirably, the bands of the bladder would cover the entire surface of the core. The bands are desirable in that they can be more easily positioned around the core by mechanical means or by hand than a bladder defining a full sphere.

Figure 16:
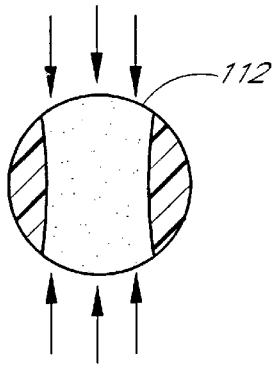
Figure 17:
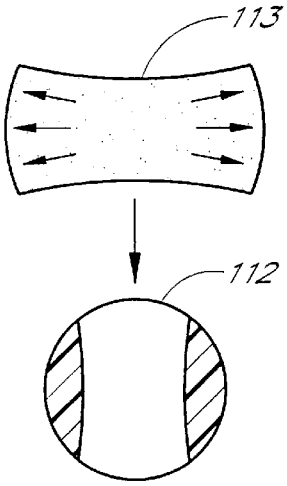
Figure 18:
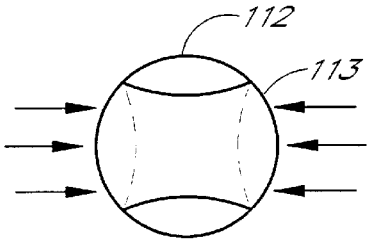
Figure 19:
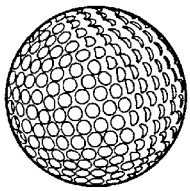
Figure 20:
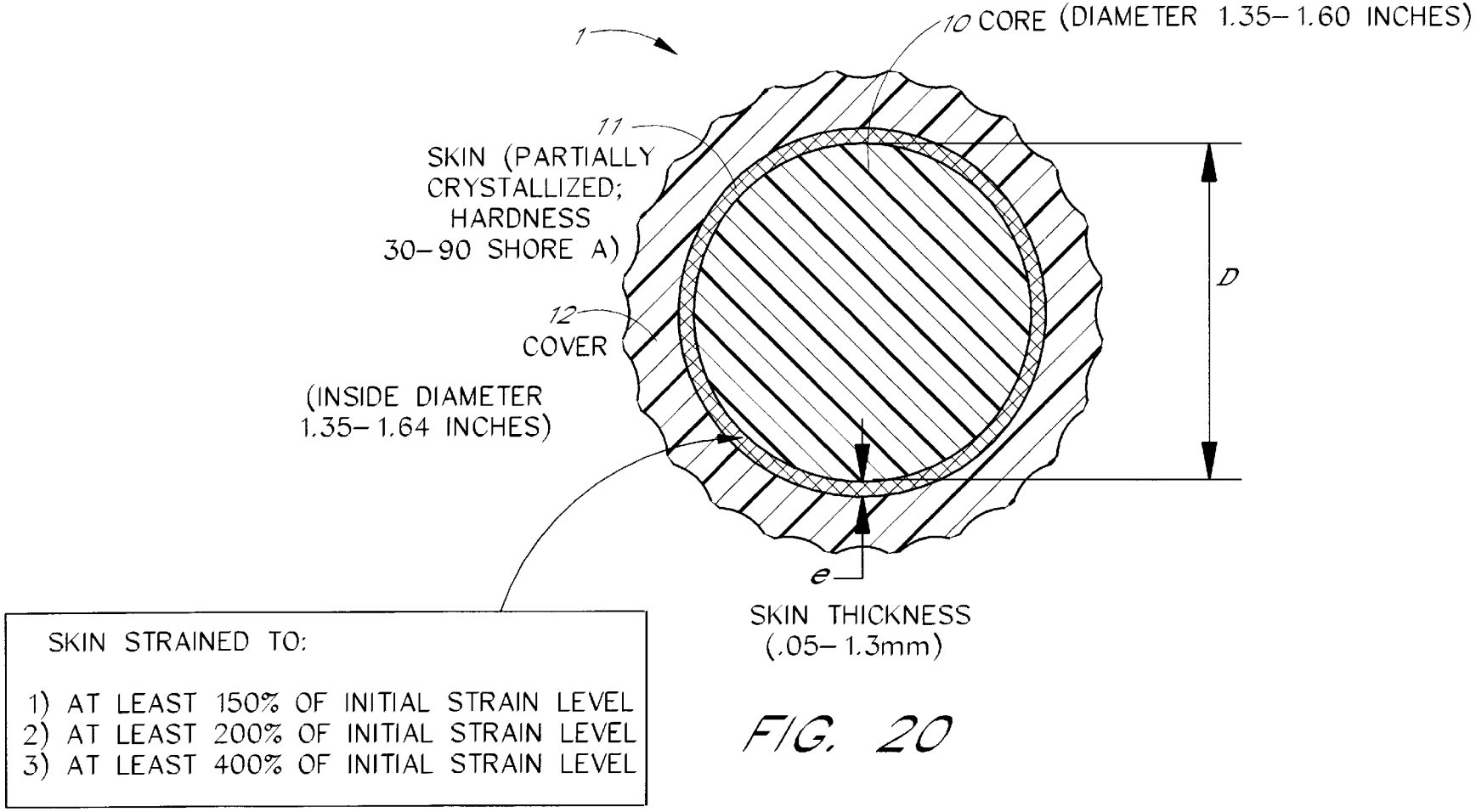
FIG. 20 is a cross-sectional view of a preferred solid golf ball of the present invention.
Figure 21:
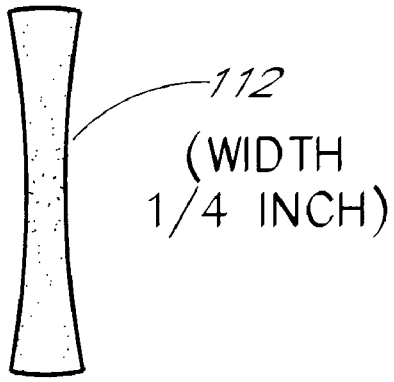
FIG. 21 illustrates an annular band of an alternative embodiment of the golf ball of the present invention.
Figure 22:
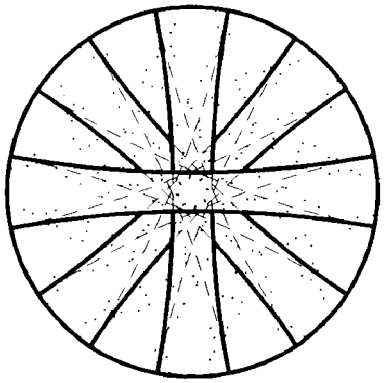
FIG. 22 illustrates an alternative embodiment of the golf ball of the present invention.

FIGS. 14–19 illustrate the steps of dressing the core with the bands 112 and 113. The first band 112 is stretched radially by any suitable mechanical means while the core is inserted into the extended annular space. The tension on the band 112 is then released, as illustrated in FIG. 16 so that the first band 112 wraps tightly around the core. The same procedure is then utilized for the second band 113, but the band is applied in a position orthogonal to the first band 112 so that the two portions of the bladder cover substantially the entire surface of the core. After the bands 112 and 113 are applied to the core, a cover is applied over the bands by any suitable technique, such as compression molding or injection molding.

The bands are preferably obtained by dipping a spherical template; then by cutting the opposite poles to form the bands. However, the bands may also be produced by extension of the continuous tube-shaped bladder which is sliced to form many bands of the desired thickness. In that case, the bands are not a portion of a sphere, but merely a portion of the tube which does not fit so intimately to the surface of the core.

In another alternative, the bands may be produced from a roll of tape having at least one face or side provided with an adhesive. Each band can be stretched around the core and maintained by the resistance produced by the adhesive in contact with the surface of the core.

It will be readily appreciated by those skilled in the art that modifications may be made without departing from the concepts disclosed herein. Such modifications are to be considered included in the following claims, unless these claims by their language expressly state otherwise.

We claim:

1. A golf ball, comprising:

a core;

a cover;

an intermediate skin of polymeric material between said core and said cover, said skin being strained to at least 150% of an initial strain level of said skin to cause crystallization of said polymeric material.

2. The golf ball of claim 1, wherein said skin is comprised of a number of discrete bands, said bands covering substantially the entire outer surface of said core.

3. The golf ball of claim 2, wherein said bands are at least ¼ inch wide.

4. The golf ball of claim 3, wherein said skin is comprised of no more than 8 bands.

5. The golf ball of claim 2, wherein each band forms a closed member.

6. The golf ball of claim 1, wherein said skin covers substantially the entire outer surface of said core.

7. The golf ball of claim 6, wherein said skin has a thickness between 0.05 mm and 1.3 mm.

8. The golf ball of claim 7, wherein said skin has a constant diameter.

9. The golf ball of claim 6, wherein said skin has a substantially uniform thickness.

10. The golf ball of claim 1, wherein said skin comprises a single piece.

11. The golf ball of claim 1, wherein said core has an external diameter and the inner surface of said skin has a maximum initial dimension in a nonstretched condition less than the external diameter of said core.

12. The golf ball of claim 1, wherein said skin comprises a rubber.

13. The golf ball of claim 12, wherein said skin comprises a rubber chosen from the group of natural rubber, synthetic polyisoprene, polybutadiene rubber, silicone rubber, polychloroprene and mixtures thereof.

14. The golf ball of claim 12, wherein said rubber is comprised between 30 to 90 Shore A.

15. The golf ball of claim 1, wherein said core comprises a solid rubber of 1,4-polybutadiene with at least 40% by weight of cis structure.

16. The golf ball of claim 1, wherein said cover comprises at least one layer of thermoplastic material chosen from the group of ionomers, polyether block amide, polyether block ester, polyurethane, balata and blends thereof.

17. The golf ball of claim 1, wherein said skin is strained to at least 200% of the initial strain level.

18. The golf ball of claim 1, wherein said skin is strained to at least 400% of the initial strain level.

19. A golf ball, comprising:

a core;

a cover;

an intermediate skin between said core and said cover, said skin strained to at least 150% of an initial strain level of said skin to cause crystallization of said skin.

20. The golf ball of claim 19, wherein said skin covers substantially the entire outer surface of said core.

21. The golf ball of claim 19, wherein said skin is comprised of no more than 8 bands.

22. The golf ball of claim 19, wherein said skin has a thickness between 0.05 mm and 1.3 mm.

23. The golf ball of claim 19, wherein said skin has a substantially uniform thickness.

24. The golf ball of claim 19, wherein said skin is strained to at least 200% of the initial strain level.

25. The golf ball of claim 19, wherein said skin is strained to at least 400% of the initial strain level.

26. The golf ball of claim 19, wherein said skin comprises a rubber.

27. The golf ball of claim 26, wherein said rubber is chosen from the group of natural rubber, synthetic polyisoprene, polybutadiene rubber, silicone rubber, polychloropropene, and mixtures thereof.

28. The golf ball of claim 26, wherein said rubber is comprised between 30 to 90 Shore A.

29. The golf ball of claim 19, wherein said skin comprises a single piece.

30. The golf ball of claim 19, wherein said skin is comprised of a number of discrete bands.

31. A multi-piece golf ball, comprising:

a core having a diameter of 1.35 to 1.60 inches;

an intermediate skin having a thickness of 0.05 to 1.3 mm, said skin strained to at least 150% of an initial strain level of said skin;

a cover having an inside diameter of 1.35 to 1.64 inches positioned over said skin.

* * * * *